US010167121B2

(12) United States Patent
Murray

(10) Patent No.: US 10,167,121 B2
(45) Date of Patent: Jan. 1, 2019

(54) CONTAINER CLOSURE

(71) Applicant: Mayoderby Limited, London (GB)

(72) Inventor: Michael Murray, London (GB)

(73) Assignee: Michael Murray, London (GB)

( * ) Notice: Subject to any disclaimer, the term of this patent is extended or adjusted under 35 U.S.C. 154(b) by 59 days.

(21) Appl. No.: 15/100,544

(22) PCT Filed: Nov. 25, 2014

(86) PCT No.: PCT/GB2014/053477

§ 371 (c)(1),
(2) Date: May 31, 2016

(87) PCT Pub. No.: WO2015/082878

PCT Pub. Date: Jun. 11, 2015

(65) Prior Publication Data

US 2016/0304255 A1 Oct. 20, 2016

(30) Foreign Application Priority Data

Dec. 2, 2013 (GB) ..... 1321212.1

(51) Int. Cl.
*B65D 51/00* (2006.01)
*B65D 51/10* (2006.01)
(Continued)

(52) U.S. Cl.
CPC ..... *B65D 51/007* (2013.01); *B65D 17/4012* (2018.01); *B65D 43/02* (2013.01);
(Continued)

(58) Field of Classification Search
CPC ..... B65D 51/007; B65D 51/04; B65D 51/10; B65D 17/165; B65D 17/166;
(Continued)

(56) References Cited

U.S. PATENT DOCUMENTS 1,143,656 A 6/1915 Spahr
1,402,559 A * 1/1922 Wright ..... B65D 47/265 220/824
(Continued)

FOREIGN PATENT DOCUMENTS

DE 102011078465 B3 7/2012
FR 417093 11/1910
(Continued)

OTHER PUBLICATIONS

European Patent Office, International Search Report in International Patent Application No. PCT/GB2014/053477, dated Jan. 30, 2015, 3 pp.
(Continued)

*Primary Examiner* — Robert Poon
(74) *Attorney, Agent, or Firm* — Leydig, Voit & Mayer, Ltd.

(57) ABSTRACT

A container has an opening and an automatic closure. A closure flap is secured to a pivot arm, the other end of which has a weighted portion. The closure flap and pivot arm are located within the container. When the container is in a normal upright position, the weighted portion biases the closure flap into a closed position. When the container is rotated in a first direction, the weighted portion causes the pivot arm and closure flap to rotate in a second, opposite direction so that the opening is exposed.

12 Claims, 5 Drawing Sheets

(51) Int. Cl.

| | |
|---|---|
| ***B65D 43/02*** | (2006.01) |
| ***B65D 43/16*** | (2006.01) |
| ***B65D 43/22*** | (2006.01) |
| ***B65D 51/18*** | (2006.01) |
| ***B65D 17/28*** | (2006.01) |

(52) U.S. Cl.
CPC ..... *B65D 43/16* (2013.01); *B65D 43/22* (2013.01); *B65D 51/10* (2013.01); *B65D 51/18* (2013.01); *B65D 2251/009* (2013.01); *B65D 2251/0018* (2013.01); *B65D 2251/0028* (2013.01); *B65D 2251/0084* (2013.01); *B65D 2517/0013* (2013.01); *B65D 2517/0014* (2013.01); *B65D 2517/0038* (2013.01); *B65D 2517/0046* (2013.01)

(58) Field of Classification Search
CPC .... B65D 2517/0032; B65D 2517/0046; B65D 47/089; B65D 51/18; B65D 17/4014; B65D 2517/0011; B65D 2517/0014; B65D 2517/044; B65D 47/0823; B65D 47/0866; B65D 43/16; B65D 43/18; F16K 17/363; A47G 19/12; A47G 19/22
USPC .... 220/254.5, 828, 264, 823, 827, 838, 824, 220/254.8, 345.4, 203.06, 259.3
See application file for complete search history.

(56) References Cited

U.S. PATENT DOCUMENTS

| | | | | | |
|---|---|---|---|---|---|
| 2,176,395 | A * | 10/1939 | Evers | B65D 47/089 | 215/307 |
| 5,054,639 | A * | 10/1991 | Ahn | B65D 77/283 | 220/706 |
| 5,096,082 | A * | 3/1992 | Hoefler | B65D 17/166 | 220/255 |
| 5,137,168 | A * | 8/1992 | Mothrath | A47G 19/12 | 222/500 |
| 5,728,415 | A * | 3/1998 | Troska | B65D 17/165 | 206/217 |
| 5,810,189 | A * | 9/1998 | Baker | B65D 17/166 | 220/257.2 |
| 6,286,703 | B1 * | 9/2001 | Munro | B65D 17/166 | 220/240 |
| 7,686,182 | B1 * | 3/2010 | Shukri | B65D 47/0823 | 215/387 |
| 7,780,046 | B1 * | 8/2010 | Lowe | B65D 45/025 | 215/235 |
| 9,315,305 | B2 * | 4/2016 | Robinson | B65D 51/007 | |
| 2006/0289540 | A1 * | 12/2006 | Lee | B65D 17/166 | 220/262 |
| 2010/0282749 | A1 | 11/2010 | Forrester | | |
| 2012/0248113 | A1 * | 10/2012 | Majcen | B65D 17/506 | 220/269 |
| 2014/0151390 | A1 * | 6/2014 | Kohler | A47G 19/12 | 220/825 |

FOREIGN PATENT DOCUMENTS

| | | | |
|---|---|---|---|
| GB | 13513 | A | 2/1911 |
| KR | 101221382 | B1 | 1/2013 |

OTHER PUBLICATIONS

United Kingdom Intellectual Property Office, Search Report in United Kingdom Patent Application No. GB1321212.1, dated Feb. 11, 2014, 1 p.
United Kingdom Intellectual Property Office, Search Report in United Kingdom Patent Application No. GB1406974.4, dated May 29, 2014, 1 p.

* cited by examiner

CONTAINER CLOSURE

CROSS-REFERENCE TO RELATED APPLICATIONS

This application is a national phase application of International Patent Application No. PCT/GB2014/053477, filed Nov. 25, 2014, which claims priority to Great Britain Patent Application No. 1321212,1, filed Dec. 2, 2013, both of which are incorporated by reference herein in their entireties for all purposes.

TECHNICAL FIELD

The present invention relates to a container with a closure which opens automatically when the container is tilted in order to dispense its contents, and which closes automatically when the container is returned to an upright position.

BACKGROUND OF THE INVENTION

Many types of container closures are well known. One example is a hinged lid or flap which must be manually opened and closed, and usually manually held out of the way to keep the container open while it is being tilted. Another example is a ring pull as on a conventional drinks can which must be manually opened and cannot then be re-closed.

In many applications, the need for manual opening and closing is undesirable or inconvenient. For containers with a ring pull-type closure it may be disadvantageous that the container cannot be re-closed when some of the contents remain inside, since they may spill accidentally or become contaminated.

SUMMARY OF THE INVENTION

The present invention provides a container having an opening and a closure movable between a first position in which the opening is closed and a second position in which the opening is exposed, the closure comprising a closure flap located within the container and a pivot arm, the pivot arm having a first end secured to the closure flap and a second end having a weighted portion, the pivot arm being pivotally mounted within the container at a pivot point located between the first and second ends, wherein when the container is in a first position the weighted portion hangs vertically from the pivot point and acts to bias the closure flap to close the opening and when the container is rotated in a first direction to a second position, the weighted portion causes the pivot arm and the closure flap to rotate relative to the container in a second direction opposite to the first direction, thereby to bias the closure flap away from the opening in order to expose the opening.

In this way, a container is provided which will be closed when it sits in a normal upright position, will open automatically when the container is tilted in order to dispense its contents, and will automatically re-close when it is returned to its upright position.

Preferably the pivot arm is pivotally secured to a support member located within the container and the pivot point is located at a position spaced from an upper surface of the container and from a side wall of the container.

Preferably the pivot arm comprises a first arm portion between the first end and the pivot point and a second arm portion between the second end and the pivot point, wherein the first and second arm portions are at an obtuse angle to one another.

The container may further comprise a locking mechanism operable by the user when desired and in any orientation of the container, to optionally retain the closure flap in the first, closed position.

In one example, the locking mechanism comprises a locking arm rotatably mounted to an upper surface of the container and a projection on the closure flap, wherein the locking arm is rotatable in order to engage the projection and prevent movement of the closure flap out of the opening.

The container may further comprise a second projection on the upper surface of the container, wherein, when the locking arm is rotated to engage the first projection, another part of the locking arm engages the second projection.

Alternatively, the locking mechanism may comprise a locking arm movably located within the container and actuation means external to the container operable to move the locking arm into a position beneath the closure flap to prevent movement of the closure flap out of the opening.

In another example, the locking mechanism may comprise a blocking member movably located in the container and actuation means external to the container operable to move the blocking means into a position to prevent pivotal movement of the pivot arm about the pivot point.

The container may further comprise a ring pull arrangement with a tab operable to break away part of a surface of the container in order to first create the opening.

Another type of container may further comprise a removable cover initially covering the opening and removable to expose the opening.

BRIEF DESCRIPTION OF THE DRAWINGS

The present invention will now be described in detail, by way of example only, with reference to the accompanying drawings, in which.

DETAILED DESCRIPTION

Figure 1:
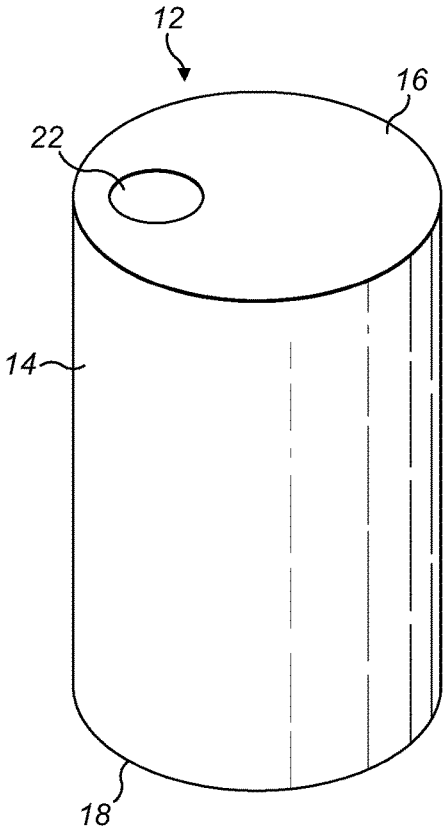
FIG. 1 is a perspective view of a container with an opening.
Figure 1A:
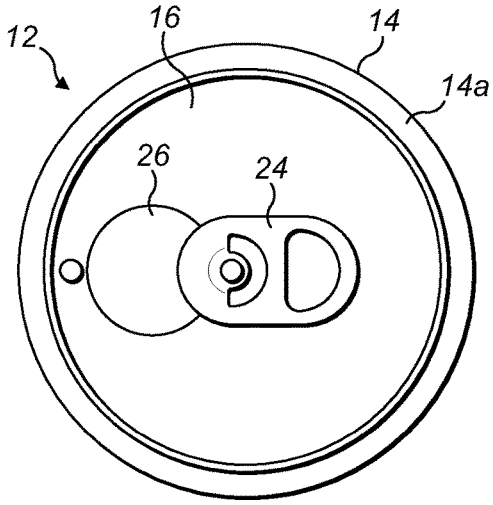
FIG. 1*a* is a top view of a container with a conventional ring pull arrangement.

FIG. 1 illustrates a typical container in which a closure 10 in accordance with the present invention may be utilised. The container 12 comprises a side wall 14, an upper surface 16 and a base 18. In this example, the side wall 14 is generally cylindrical and the upper surface 16 and base 18 are circular, but any other shape of container may be used. The upper surface 16 and/or base 18 may be of the same diameter as the side wall 14, or of a smaller diameter, in which case they may be joined to the side wall by an annular sloping shoulder 14*a*. This is common in conventional drinks cans using ring pulls, as shown in FIG. 1*a*.

The upper surface 16 defines an opening 22 for dispensing contents from the container 12. The opening 22 is located eccentrically in the upper surface 16, towards its outer perimeter 20 but with a small spacing between the opening 22 and the outer perimeter 20.

Figure 1B:
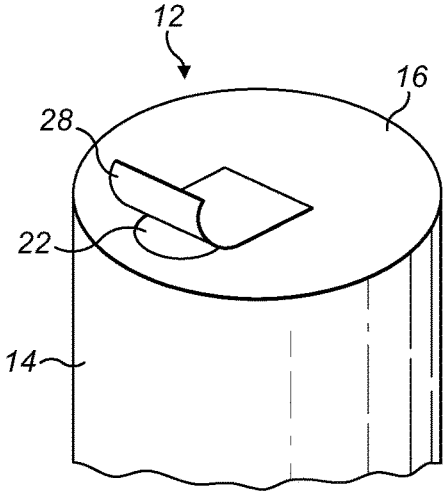
FIG. 1*b* is a perspective view of an upper part of a container with a tearaway cover.

The opening 22 may simply be a preformed aperture in the upper surface 16 as shown in FIG. 1. Alternatively, the opening 22 may initially be closed. For example, as shown in FIG. 1*a*, the container 12 may also include a conventional ring pull arrangement with an external tab 24 operable by a user to break a section 26 out of the upper surface 16 and force it into the container 12 to create the opening 22. Alternatively, as shown in FIG. 1*b* the opening 22 may be preformed in the upper surface 16 but protected with a removable cover 28, for example, of foil or plastic, which can be manually torn away to reveal the opening 22.

Figure 2A:
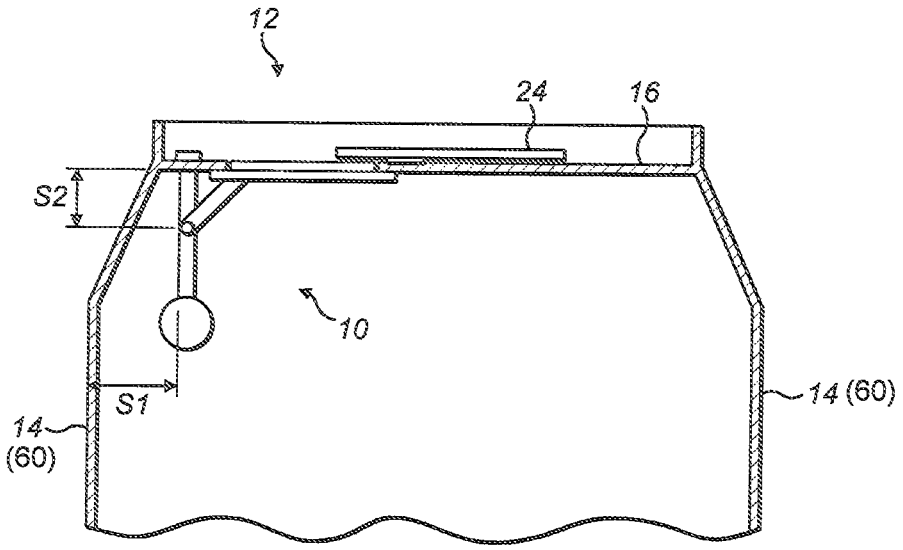
FIG. 2*a* is a cross-sectional view of a portion of the container of FIG. 1*b*, also showing a side view of a closure in accordance with the present invention mounted in the container.
Figure 2B:
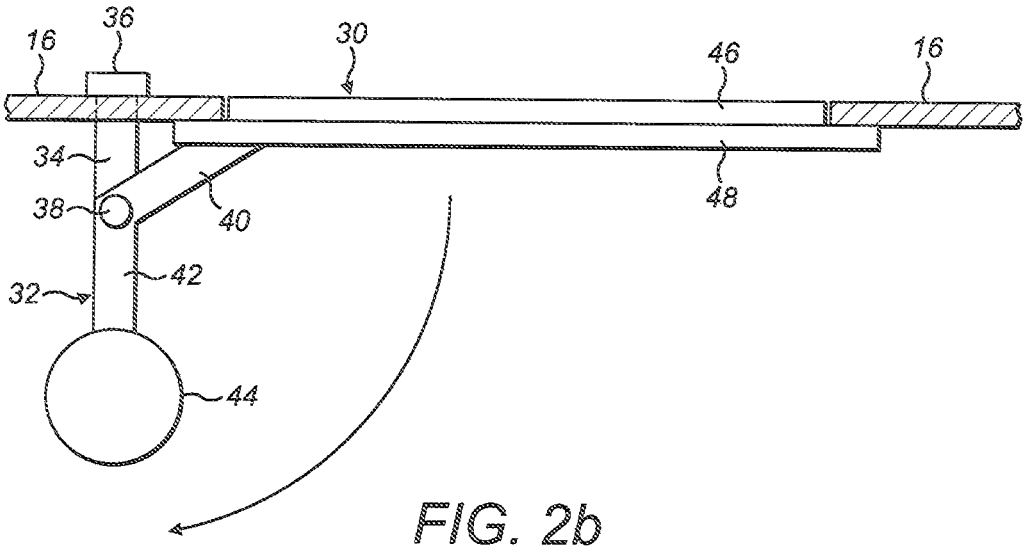
FIG. 2*b* is an enlarged view of the closure of FIG. 2*a;*

The closure 10 of the present invention is mounted within the container 12 as shown in FIG. 2. In this embodiment, the closure 10 comprises a closure flap 30, a weighted pivot arm 32 and a support member 34.

The support member 34 extends downwardly from the interior of the upper surface 16. It may be a separate item attached to the upper surface 16. For example, it may be a short rod which passes through an aperture in the upper surface 16 and is secured in place by an external rivet 36. Alternatively, the support member 34 may be bonded or adhered in some way to the interior of the upper surface 16. It could also be formed integrally with the upper surface 16, for example, if the upper surface 16 and support member 34 are formed as a unitary plastic moulding. The support member 34 is located a small distance radially inwardly of the perimeter 20 of the side wall 14. Thus, a spacing S1 is provided between the support member 34 and the side wall 14.

The pivot arm 32 is pivotally secured to the support member 34, for example, by a pivot pin 38 which provides a pivot axis. The pivot pin 38 is spaced a small distance S2 below the upper surface 16. The pivot arm 32 comprises a first portion 40 and a second portion 42 extending either side of the pivot pin 38. The closure flap 30 is secured to the end of the first arm portion 40. A weight 44 is located at the end of the second arm portion 42. This may be formed integrally with the second arm portion 42 as an enlarged end part, or it may be a heavy bead attached to the end of the pivot arm 32. The first and second arm portions 40, 42 are preferably arranged at an obtuse angle relative to one another as shown. The combined weight of the second arm portion 42 and the weight 44 is greater than the combined weight of the first arm portion 40 and the closure flap 30.

When the container 12 is in a normal rest or storage position in which it stands upright as shown in FIG. 2, the weight 44 acts to pull the pivot arm 32 into the position shown in which the second arm portion 42 hangs vertically downwardly from the pivot pin 38. The first arm portion 40 extends upwardly from the pivot pin 38 at an angle between the horizontal and vertical towards the upper surface 16. The closure flap 30 is secured to the end of the first arm portion 40 and in this first position, extends horizontally and locates within the opening 22 in order to close the opening 22.

Preferably, the closure flap 30 comprises a closure member 46 uppermost which is the same shape as the opening 22 but very slightly smaller, so that it sits within the opening 22 and substantially closes it. For enhanced sealing of the opening 22, the closure flap 30 preferably also comprises a sealing member 48 which lies beneath the closure member 46 and is larger all round. This locates against the interior of the upper surface 16 of the container 12, completely surrounding the opening 22, in order to close any gaps between the edge of the opening 22 and the closure part 46.

In order to dispense the contents of the container 12, any initial closure such as a ring pull or tear-away cover is activated/removed in order to expose the opening 22. The container is then tilted away from the vertical and in a direction towards the opening 22, e.g. it is rotated anti-clockwise from the FIG. 2 position to that shown in FIG. 3. The effect of gravity on the weight 44 causes the pivot arm 32 to pivot about the pin 38 so that, in effect, the pivot arm 32 rotates in the opposite direction relative to the container 12, so as to retain the second arm portion 42 in a substantially vertical orientation. Therefore, the pivot arm 32 actually remains substantially in the same position while the container 12 tilts relative to the pivot arm 32. The spacing S1 between the second arm portion 42 and the side wall 14 allows room for relative movement in this way. As the second arm portion 42 moves towards the side wall 14, the first arm portion 40 swings away from the upper surface 16, removing the closure flap 30 from the opening 22. Contents can then be dispensed from the container 12 through the opening 22 in the normal way.

Figure 3:
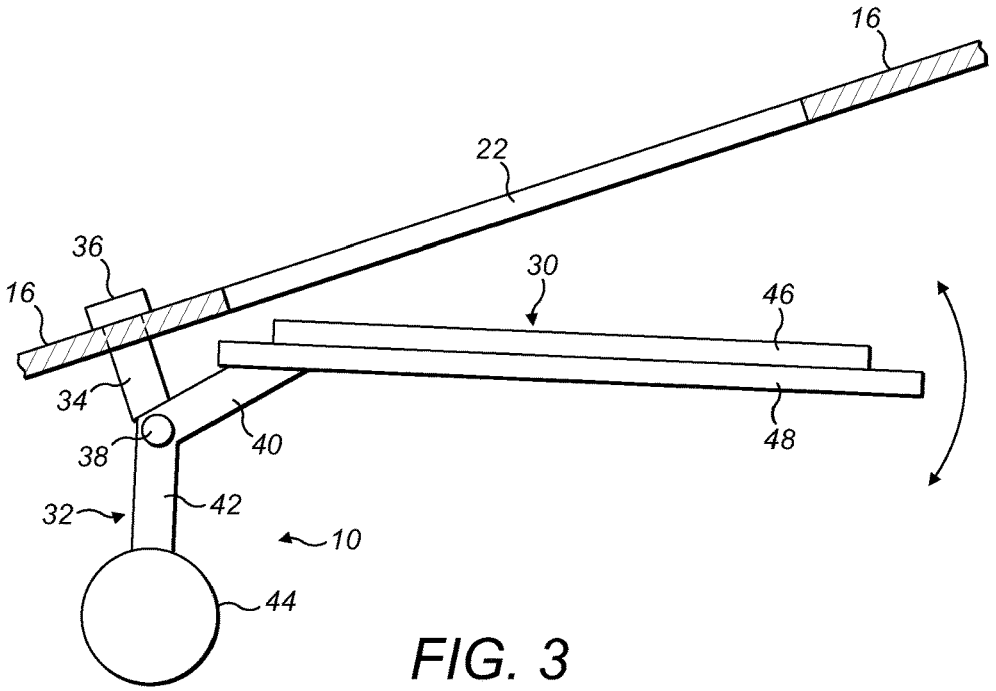
FIG. 3 is similar to FIG. 2*b* but shows the relative positions of the container and the closure when the container is in the second, tilted position.

Since the entire closure mechanism 10 is located within the container 12 it does not in any way affect or get in the way of a user attempting to drink from the container. Furthermore, the location of the closure flap 30 relative to the opening 22 when the container 12 is tilted improves the flow characteristics of liquid exiting the container 12. With reference to FIG. 3, when the container 12 is tilted anti-clockwise the left hand side of the opening 22 is lowermost, the right hand side uppermost, and the left hand side of the closure flap 30 is closest to the opening 22. Thus, at least when the container 22 is quite full, the right hand edge of the closure flap 30 points into the flow of liquid exiting the container. The flap 30 has a very narrow profile and therefore liquid can flow smoothly over the top of the flap 30 in order to exit the container 12. As the container 12 becomes emptier, more of the exit flow of liquid may impinge on the underside at the closure flap 30, towards the left hand side. However, experiments have shown that the liquid simply flows around the edges of the flap 30 and still exits the container smoothly. Air is always able to enter the container 12 towards the right hand side of the opening 22 in order to allow the liquid to flow out smoothly without "glugging".

When a sufficient amount has been dispensed, the container 12 is returned to its starting position, i.e., rotated clockwise from the FIG. 3 position to the FIG. 2 position. Gravity acting on the weight 44 again causes the pivot arm 42 to pivot about the pin 38 relative to the container 12 to return to the starting position. The closure flap 30 is thus pivoted back towards the upper surface 16 in order to close the opening 22.

Thus, tilting the container 12 automatically opens the container and restoring it to the vertical automatically closes it. No user intervention is required other than tilting the container 12 and there is no need to touch the closure itself or the upper surface 16 in the vicinity of the opening 22.

If the container 12 includes a conventional ring pull arrangement as in FIG. 1*a,* before the ring pull is operated the closure flap 30 simply sits beneath the breakaway section 26 of the upper surface 16. As the ring pull tab 24 is operated and the breakaway section 26 is severed from the upper surface and forced into the container 12, it pushes the closure flap 30 downwardly. Once the tab 24 has fully bent the breakaway section 26 away from the opening 22 and back beneath the upper surface 16, the breakaway section 26 is out of the way of the closure flap 30, and the closure flap 30 can move fully upwardly to close the opening 22.

Figure 4:
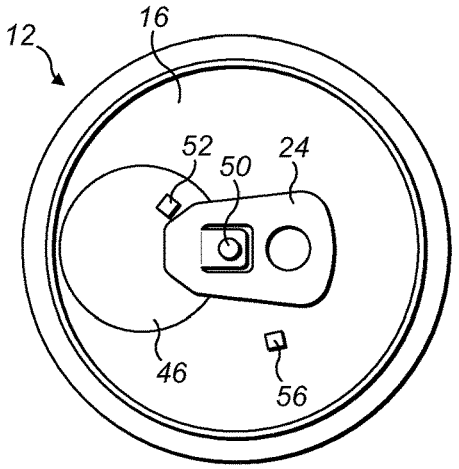
FIG. 4 is a top view of a container including a first embodiment of a locking mechanism, shown in the unlocked position.
Figure 4A:
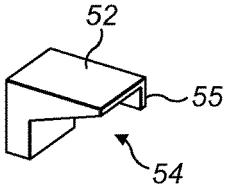
FIG. 4*a* is an enlarged perspective view of one of the locking projections shown in FIG. 4.
Figure 5:
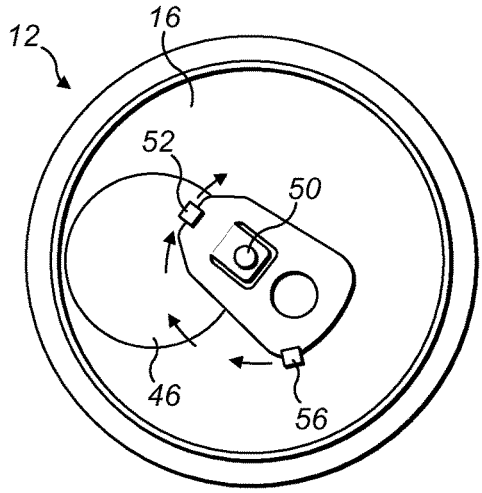
FIG. 5 is a top view as FIG. 4 but showing the locking mechanism in the locked position.

In some situations, it may be desirable to have a locking mechanism which the user can operate when desired to keep the container 12 closed even when it is tilted, for example, to prevent spillage of the contents if the container is tilted accidentally. One example of a locking mechanism is illustrated in FIGS. 4, 4*a* and 5. This shows part of the upper surface 16 of a container 12, the opening 22 and the closure member 46 in place to close the opening 22. In this example, the container 12 is provided with a tab 24, such as a conventional ring pull tab, secured to the upper surface 16 by a rivet 50. The tab 24 may be used as a lever to initially breakaway part 26 of the upper surface 16 to create the opening 22 in the normal ring pull fashion. The tab 24 is also rotatable about the rivet 50 while remaining generally parallel to the upper surface 16 as shown by the arrows in FIG. 4.

In this embodiment, the closure part 46 is provided with a projection 52 shaped as an inverted L-shape or a wedge as best seen in the enlarged view of FIG. 4*a*. A gap 54 is created between the projection 52 and the closure part 56. The tab 24 may be rotated about the rivet 50 so that part of it engages in the gap 54, thereby preventing the closure part 46 from swinging down and out of the opening 22. The projection 52 may include a stop 55 to limit rotation of the tab 24 into the gap 54 and to prevent it rotating all the way through and out of the other side. The projection 52 and/or the tab 24 may be shaped such that as the tab 24 moves further into the gap 54 it causes the closure flap 30 to engage more tightly with the upper surface 16, in order to reduce the risk of any leakage.

A second projection 56, of the same general form as the first projection 52, may also be provided on the upper surface 16. Therefore, as the tab 24 is rotated into engagement with the first projection 52, another portion of the tab 24 may be received in the gap created between the second projection 56 and the upper surface 16, in order to lock the tab 24 and the closure flap 30 even more securely. The second projection 56 may also include a stop to limit rotation of the tab 24.

If preferred, the tab 24 may not be associated with a conventional ring pull mechanism and may be present purely as a locking tab, rotatable on the upper surface 16 to engage and disengage with the projection(s) 52, 56.

Figure 6:
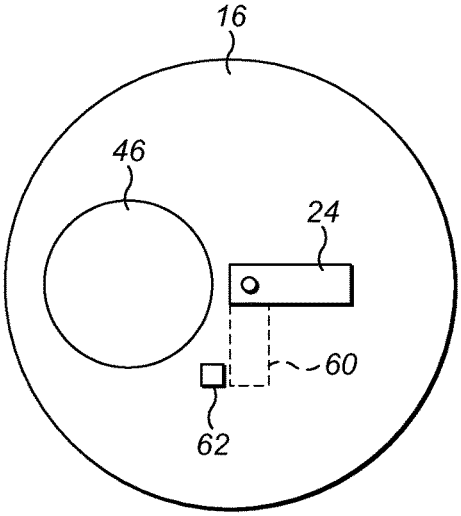
FIG. 6 is a top view of a container including a second embodiment of a locking mechanism, shown in the unlocked position.
Figure 7:
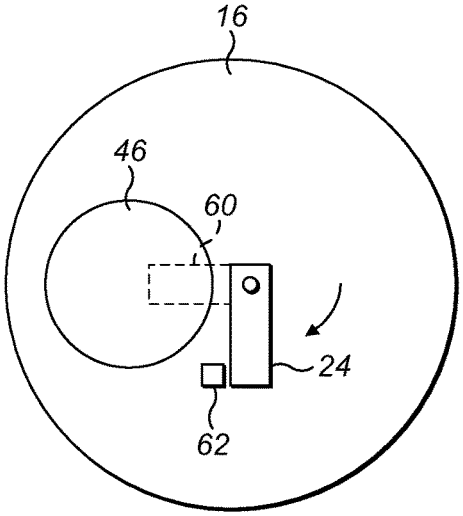
FIG. 7 is a top view as FIG. 6 but showing the locking mechanism in the locked position.

Alternative locking mechanisms may also be envisaged. As shown in FIGS. 6 and 7, instead of using the locking projections 52, 56 mounted on the closure flap 30 and the upper surface 16, the tab 24 could be connected to a locking arm 60 located inside the container 12 below the upper surface 16, such that rotation of the tab 24 also causes rotation of the locking arm 60 so that it moves beneath the closure flap 30 to prevent the closure flap 30 moving away from the opening 22. A stop member 62 may be provided in order to prevent the locking arm 60 from rotating further than required.

Another approach is to prevent the pivot arm 32 from being able to swing as the container 12 is tilted. For example, some form of blocking member may be provided inside the container 12 which can be operated from outside the container 12 and caused to move into a blocking position when locking is required and moved out of the way of the pivot arm 32 when automatic opening and closing is required.

Figure 8:
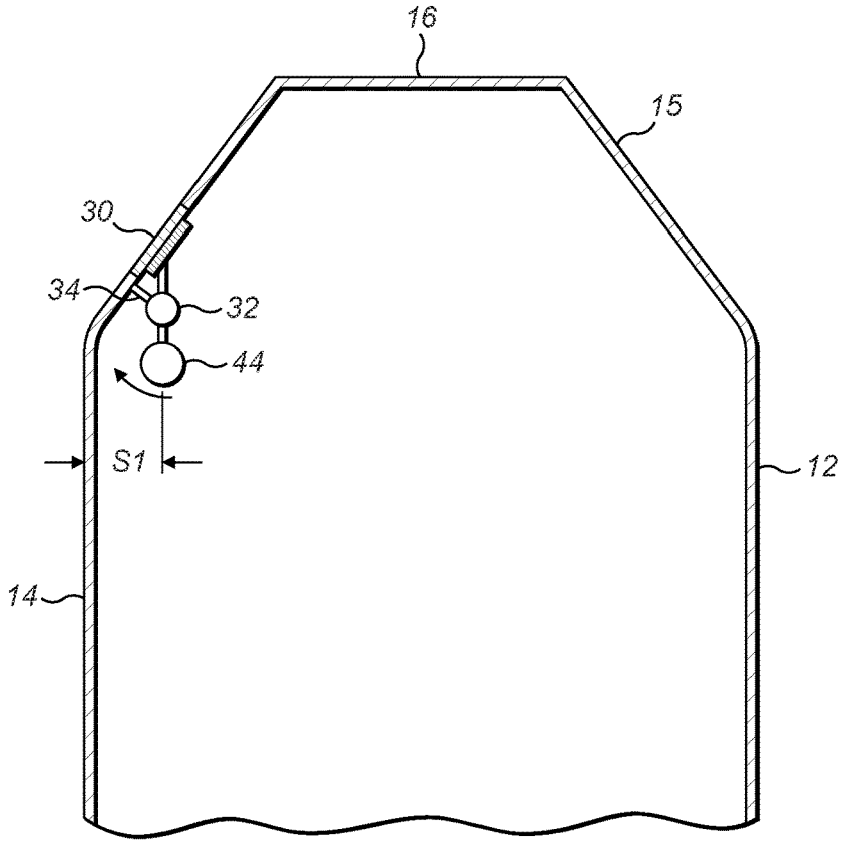
FIG. 8 is a cross-sectional view of a portion of a different configuration of container, also including a closure in accordance with the invention.
Figure 9:
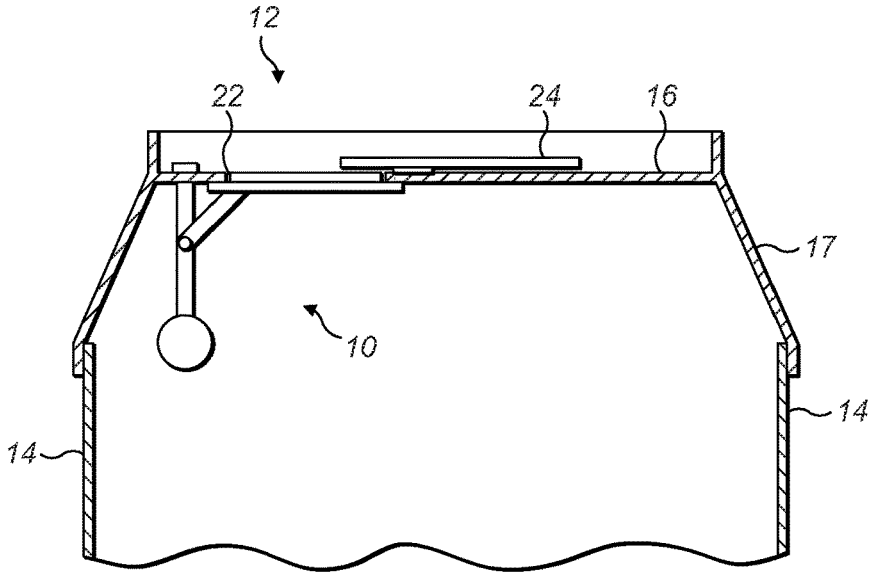
FIG. 9 is an fragmentary, cross sectional, side view of a container showing an alternate embodiment of, a closure mounted on the container in accordance with the invention.

In the embodiments described above, the container 12 is shown with the opening 22 in a substantially horizontal upper surface 16. However, the invention is also applicable to containers of different configurations. For example, in the embodiment shown in FIG. 8, a container 12 has a generally frustoconical upper portion with a sloping wall 15 joining the side wall 14 to the upper surface 16. The opening 22 is located in the sloping wall 15.

The closure 10 is generally the same as described above, although the angle between the first and second arm portions 40, 42 is larger to suit the geometry of the container 12. The support member 34 protrudes from the sloping wall 15, generally perpendicular thereto. There is still a spacing S1 between the pivot axis and the side wall 14, allowing the relative movement between the container 12 and the pivot arm 32 as the container 12 is tilted.

Thus, the invention is not limited to a container with an opening in a substantially horizontal upper surface, but can be applied to any container with an opening, where the container must be tilted in order to dispense contents through the opening.

The invention has been described above with reference to a container 12 in Which the opening 22 is formed directly in the container itself and the entire opening 22 is closed by the closure flap 30. However, it will be appreciated that the invention may also he provided as part of a separate lid 60 which can be mounted to a container to cover the opening. For example, if the top of a container is completely open, or its entire top surface is removable to provide an open top, a lid 60 may then be fitted over the container to close the open top. The surface of the lid 60 then forms the upper surface 16 and defines the dispensing opening 22. The closure 10 is provided as part of the lid 60 itself in order to provide a closure for the opening 22.

The present invention provides an improved container closure, which automatically opens and recloses a container as the container is tilted. It will be appreciated that while specific examples have been described, the precise configuration of the container and opening, and parts such as the pivot arm, closure flap and locking mechanism, may be varied or modified without departing from the scope of the claims.

The invention claimed is:

1. A container having an opening and a closure movable between a first position in which the opening is closed and a second position in which the opening is exposed, the closure comprising a closure flap located within the container and a pivot arm, the pivot arm having a first end secured to the closure flap and a second end having a weighted portion, the pivot arm being pivotally mounted within the container at a pivot point located between the first and second ends, wherein when the container is in a first position, the weighted portion acts to bias the closure flap to close the opening and when the container is rotated in a first direction to a second position, the weighted portion causes the pivot arm and the closure flap to rotate relative to the container in a second direction opposite to the first direction, thereby to bias the closure flap into the container and away from the opening in order to expose the opening.

2. A container as claimed in. claim 1, wherein the pivot arm is pivotally secured to a support member located within the container and the pivot point is located at a position spaced from an upper surface of the container and from a side wall of the container.

3. A container as claimed in claim 1, wherein the pivot arm comprises a first arm portion between the first end and the pivot point and a second arm portion between the second end and the pivot point, wherein the first and second arm portions are at an obtuse angle to one another.

4. A container as claimed in claim 1, further comprising a locking mechanism operable by the user when desired and in any orientation of the container to selectively retain the closure flap in the first, closed position.

5. A container as claimed in claim 4, wherein the locking mechanism comprises a locking arm rotatably mounted to an upper surface of the container and a projection on the closure flap, wherein the locking arm is rotatable in order to engage the projection and prevent movement of the closure flap out of the opening.

6. A container as claimed in claim 5, further comprising a second projection on the upper surface of the container, wherein, when the locking arm is rotated to engage the first projection, another part of the locking arm engages the second projection.

7. A container as claimed in claim 4, wherein the locking mechanism comprises a locking arm movably located within the container and actuation means external to the container operable to move the locking arm into a position beneath the closure flap to prevent movement of the closure flap out of the opening.

8. A container as claimed in claim 4, wherein the locking mechanism comprises a blocking member movably located in the container and actuation means external to the container operable to move the blocking means into a position to prevent pivotal movement of the pivot arm about the pivot point.

9. A container as claimed in claim 1, further comprising a ring pull arrangement with a tab operable to break away part of a surface of the container in order to first create the opening.

10. A container as claimed in claim 1, wherein the container further comprises a removable cover initially covering the opening and removable to expose the opening.

11. A container as claimed in claim 1, wherein the closure is mounted on a lid mountable on the container over the opening.

12. A container as claimed in claim 1, wherein when the container is in the first position, the weighted portion hangs vertically from and substantially perpendicularly to the pivot.

* * * * *